US009073656B2

(12) United States Patent
Mader

(10) Patent No.: US 9,073,656 B2
(45) Date of Patent: Jul. 7, 2015

(54) SEALING STATION AND METHOD FOR CUTTING A COVER FILM

(75) Inventor: Andreas Mader, Dietmannsried (DE)

(73) Assignee: MULTIVAC SEPP HAGGENMUELLER GMBH & CO. KG, Wolfertschwenden (DE)

( * ) Notice: Subject to any disclaimer, the term of this patent is extended or adjusted under 35 U.S.C. 154(b) by 881 days.

(21) Appl. No.: 13/270,480

(22) Filed: Oct. 11, 2011

(65) Prior Publication Data

US 2012/0085069 A1 Apr. 12, 2012

(30) Foreign Application Priority Data

Oct. 12, 2010 (EP) ..... 10 013 569

(51) Int. Cl.

| | |
|---|---|
| ***B65B 51/10*** | (2006.01) |
| ***B65B 51/14*** | (2006.01) |
| ***B65B 61/06*** | (2006.01) |
| ***B65B 7/16*** | (2006.01) |

(52) U.S. Cl.

CPC ..... *B65B 61/065* (2013.01); *B65B 7/162* (2013.01)

(58) Field of Classification Search

CPC ..... B65B 7/16; B65B 7/162; B65B 7/164; B65B 7/167; B65B 51/14; B29C 65/18

USPC ..... 53/300, 329, 329.2, 329.3, 329.5, 478, 53/477, 484

See application file for complete search history.

(56) References Cited

U.S. PATENT DOCUMENTS

| | | | | |
|---|---|---|---|---|
| 3,298,158 | A * | 1/1967 | Schmidt | 53/510 |
| 3,583,125 | A * | 6/1971 | Vermeulen | 53/412 |
| 4,424,659 | A | 1/1984 | Perigo et al. | |
| 4,707,213 | A * | 11/1987 | Mohr et al. | 156/380.2 |
| 4,961,513 | A * | 10/1990 | Gossedge et al. | 220/276 |
| 5,056,296 | A * | 10/1991 | Ross et al. | 53/478 |
| 5,447,736 | A * | 9/1995 | Gorlich | 426/396 |
| 5,534,282 | A | 7/1996 | Garwood | |
| 5,779,050 | A * | 7/1998 | Kocher et al. | 206/497 |
| 6,050,055 | A * | 4/2000 | Calvert et al. | 53/300 |
| 6,305,149 | B1 * | 10/2001 | Gorlich et al. | 53/478 |
| 6,351,928 | B2 * | 3/2002 | Torre | 53/556 |
| 6,488,972 | B1 * | 12/2002 | Cerani | 426/110 |
| 6,748,726 | B2 * | 6/2004 | Rossi et al. | 53/510 |
| 6,834,476 | B2 * | 12/2004 | Konishi | 53/329.5 |
| 7,028,449 | B2 * | 4/2006 | Salvoni | 53/510 |
| 7,269,932 | B2 * | 9/2007 | Konishi | 53/329.5 |
| 7,412,810 | B2 * | 8/2008 | Konishi | 53/329.5 |
| 7,600,358 | B2 * | 10/2009 | Natterer | 53/432 |

(Continued)

FOREIGN PATENT DOCUMENTS

| | | |
|---|---|---|
| DE | 100 31 356 A1 | 1/2002 |
| EP | 2 251 264 A1 | 11/2010 |

(Continued)

OTHER PUBLICATIONS

European Search Report Dated Mar. 10, 2011, Application No. EP 10 01 3569, 2 Pages.

*Primary Examiner* — Gloria R Weeks

(74) *Attorney, Agent, or Firm* — Husch Blackwell LLP

(57) ABSTRACT

The disclosure relates to a method for cutting a cover film as well as to a sealing station of a tray sealing machine, whereby a blade is arranged on a sealing frame or on a tool lower part and the sealing frame executes a relative movement with respect to the sealing tool lower part.

17 Claims, 9 Drawing Sheets

(56) References Cited

U.S. PATENT DOCUMENTS

| | | | | |
|---|---|---|---|---|
| 7,665,281 | B2 * | 2/2010 | Send et al. | 53/561 |
| 8,381,497 | B2 * | 2/2013 | Scheibel et al. | 53/449 |
| 2003/0131568 | A1 * | 7/2003 | Rossi et al. | 53/510 |
| 2003/0196412 | A1 * | 10/2003 | Foulke, Jr. | 53/432 |
| 2005/0247593 | A1 * | 11/2005 | Salvoni | 206/557 |
| 2006/0048480 | A1 * | 3/2006 | Konishi | 53/329.3 |
| 2006/0123739 | A1 * | 6/2006 | Konishi | 53/329.3 |
| 2010/0287881 | A1 * | 11/2010 | Ehrmann et al. | 53/170 |
| 2010/0287893 | A1 * | 11/2010 | Ehrmann et al. | 53/487 |
| 2011/0167762 | A1 * | 7/2011 | Holzem et al. | 53/329 |
| 2012/0324835 | A1 * | 12/2012 | Ickert et al. | 53/476 |
| 2013/0055688 | A1 * | 3/2013 | Jokele | 53/476 |

FOREIGN PATENT DOCUMENTS

| | | | |
|---|---|---|---|
| WO | 97/46447 | A1 | 12/1997 |
| WO | 99/43266 | A2 | 8/1999 |

* cited by examiner

SEALING STATION AND METHOD FOR CUTTING A COVER FILM

CROSS-REFERENCE TO RELATED APPLICATIONS

This application claims foreign priority benefits under 35 U.S.C. §119(a)-(d) to European patent application number EP 10 013 569.8, filed Oct. 12, 2010, which is hereby incorporated by reference in its entirety.

TECHNICAL FIELD

The disclosure relates to a method for cutting a cover film as well as to a sealing station for a tray sealing machine.

BACKGROUND

Tray sealing machines that cut a cover film in a sealing station before the cover film is applied to the tray to be sealed are known from the state of the art. A blade is typically arranged on a sealing frame in such a way that it juts out in the direction of movement so far that the cover film is cut before the cut cover film is clamped onto the tray by a sealing frame and the sealing subsequently takes place.

The disadvantage of this technique is that the position of the cut cover film on the tray is not process-reliable.

Other tray sealing machines, in which the cover film is cut after being clamped on and after or during the sealing process, have a device that allows the blade to be moved independently of the sealing frame and the cover film in such a way that the cover film is cut outside the tray.

The disadvantage of this execution is that the cut film is cut outside the tray edge and the area between the sealing seam and the outer edge of the cover film is not fixed in place or is loose.

SUMMARY

An object of the present disclosure is to provide a method for cutting a cover film and to provide a sealing station of a tray sealing machine in which the aforementioned disadvantages can be eliminated.

The following steps are provided in a method according to the disclosure for cutting a cover film in a sealing station of a tray sealing machine:

- Clamping the cover film in a first area by means of a tool upper part and a tool lower part of the sealing station,
- Clamping the cover film and a tray in a second area by means of a sealing frame and a tray holder,
- Relative movement of the sealing frame and the tray holder with the first area of the cover film and the tray with respect to the tool lower part,
- Cutting the cover film during the relative movement by means of contact between the cover film and at least one blade that is mounted on the sealing frame or on the tool lower part.

This method allows the cover film to be cut after the cover film has been clamped to the tray by means of the sealing frame without an additional device for moving the blades with respect to the film being necessary. This leads to economical cutting.

In a preferred method, the relative movement of the sealing frame to the tray holder and to the second area of the cover film and the tray is executed in the direction of the tool lower part. The movement of the sealing frame for clamping the cover film on the tray can consequently be retained for the following cutting step in the same activation direction in order to execute both functions in one sequence of movements.

An area of the cover film that is located between the first and second area of the cover film is preferably tautened diagonally by the relative movement. This diagonal position brings about contact with the blade.

The blade preferably cuts the cover film between a sealing seam and an outer edge of the tray. This method allows the cover film to be cut close to an outer edge of a sealing seam after the cover film has been securely clamped to the tray by means of the sealing frame. This leads to a very attractive appearance of the package because there is no cover film loosely sticking out over the sealing seam.

The cutting of the cover film is preferably executed before the cover film is sealed to the tray. Towards the end of the relative movement of the sealing frame and the tray holder, the cover film is cut by the blade before the tray holder strikes the tool lower part. The cutting of the cover film is thereby brought about simultaneously for all trays located in the sealing station.

The sealing frame preferably produces a sealing force on the cover film and tray at the end of the relative movement. The tool lower part of the sealing station thereby acts as a counterpressure system.

The interior of the tray is preferably evacuated and/or treated with gas before the sealing in order to achieve a long shelf life if the product in question is a food product.

A sealing station, according to the present disclosure, for a tray sealing machine has a tool upper part and a tool lower part for clamping the cover film in a first area, as well as a sealing frame and a tray holder for clamping a cover film to a tray in a second area. The sealing station furthermore has a lifting device for the sealing frame, and a blade for cutting the cover film is arranged on the sealing frame or tool lower part. The sealing frame and the tray holder, together with the second area of the cover film and the tray, can be moved relative to the tool lower part. In the case of the execution according to the disclosure, in which the blade is provided without a separate or additional operating mechanism, a sealing station can be executed in a manner that is economical and space-saving.

The lateral distance between the blade and the sealing frame is preferably less than 5 mm, more preferably less than 3 mm. In this way, the cover film can be cut very close to a sealing seam, which gives the package an especially attractive appearance because the portion of loose film in the edge area of the package is reduced to a minimum. The front edge of the blade can stand back from the sealing frame, or jut out somewhat from it, or the two can be level. The lifting movement of the sealing frame preferably covers 4 mm to 8 mm. The distance between the blade and the interior side of the tool upper or tool lower part preferably amounts to 2 mm to 4 mm.

The blade is preferably formed so that it is ring-shaped corresponding to the exterior contour of the sealing seam.

The lifting device of the sealing device is in an advantageous manner suitable for producing a sealing force on the cover film and the tray in the area of the sealing seam via the sealing frame in a position in which the tray holder comes into contact with the tool lower part.

In the following, an advantageous embodiment of the disclosure is described in more detail with reference to the below drawings.

DETAILED DESCRIPTION

Components that are the same or similar in the figures are given the same reference numbers throughout.

Figure 1:
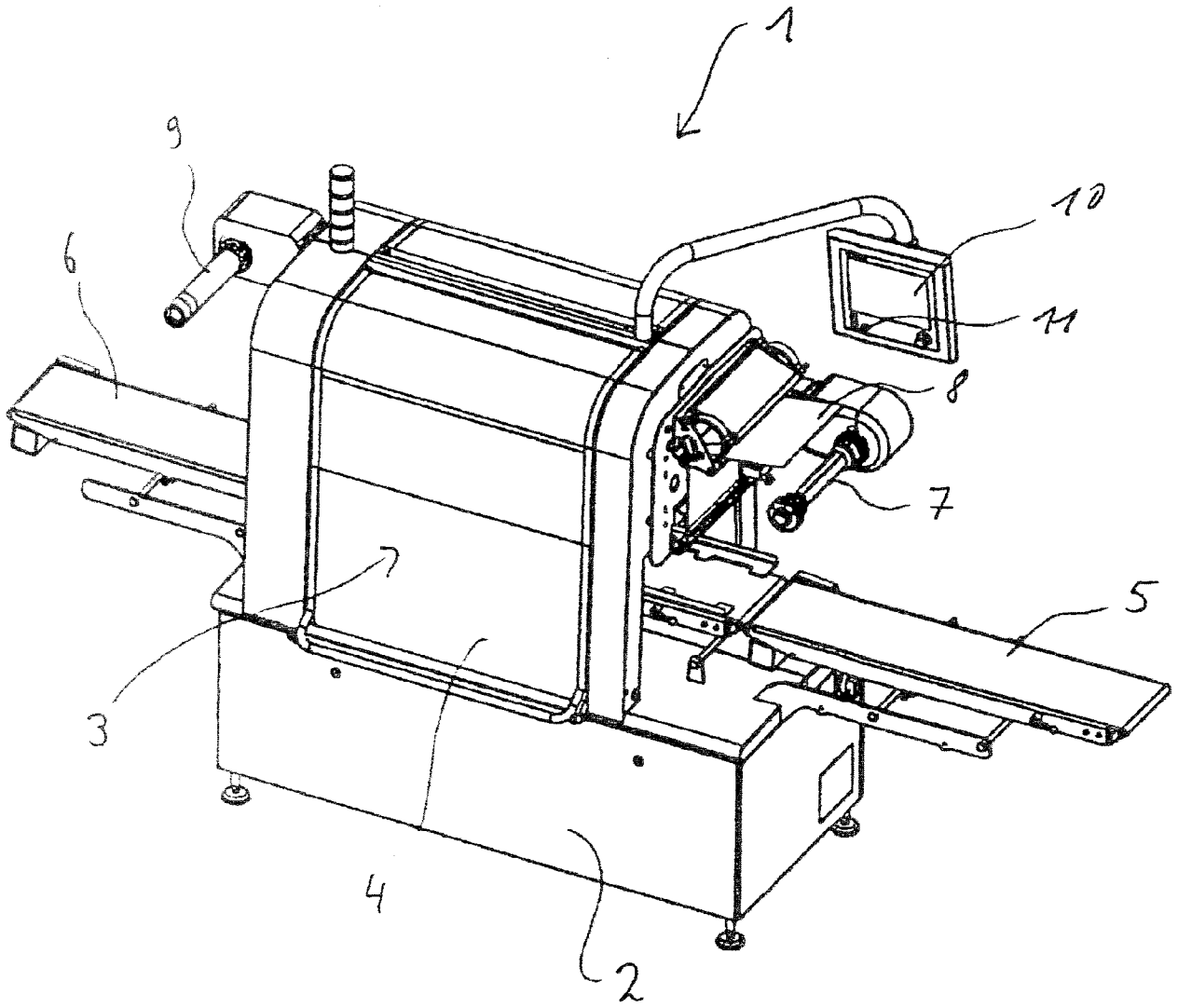
FIG. 1 is a perspective view of a packaging machine according to the disclosure.

FIG. 1 is a perspective view of a first embodiment of a packaging machine 1 according to the present disclosure. This embodiment involves a tray sealer. The packaging machine 1 has a machine frame 2, on which is arranged a sealing station 3 for closing and, where applicable, for sealing and/or evacuating and/or treating with gas, the supplied, tray-shaped containers as well as for cutting a cover film that is used for sealing. The sealing station 3 is located below a protective cover 4.

The packaging machine 1 furthermore has a feeding conveyor belt 5 for feeding the containers, a removal conveyor belt 6 for transporting the closed containers away, a film feeding roll 7 for holding and feeding a cover film 8, which is shown only in sections, as well as a remaining film winder 9 for winding the web of film of the cover film 8 left after the sealing. A display 10 allows the operator of the packaging machine 1 to examine and control the operation of the packaging machine 1. Operating controls 11, for example, control panels or switches, can be provided on the display 10 for this purpose in order to influence the operation of the packaging machine 1.

Figure 2:
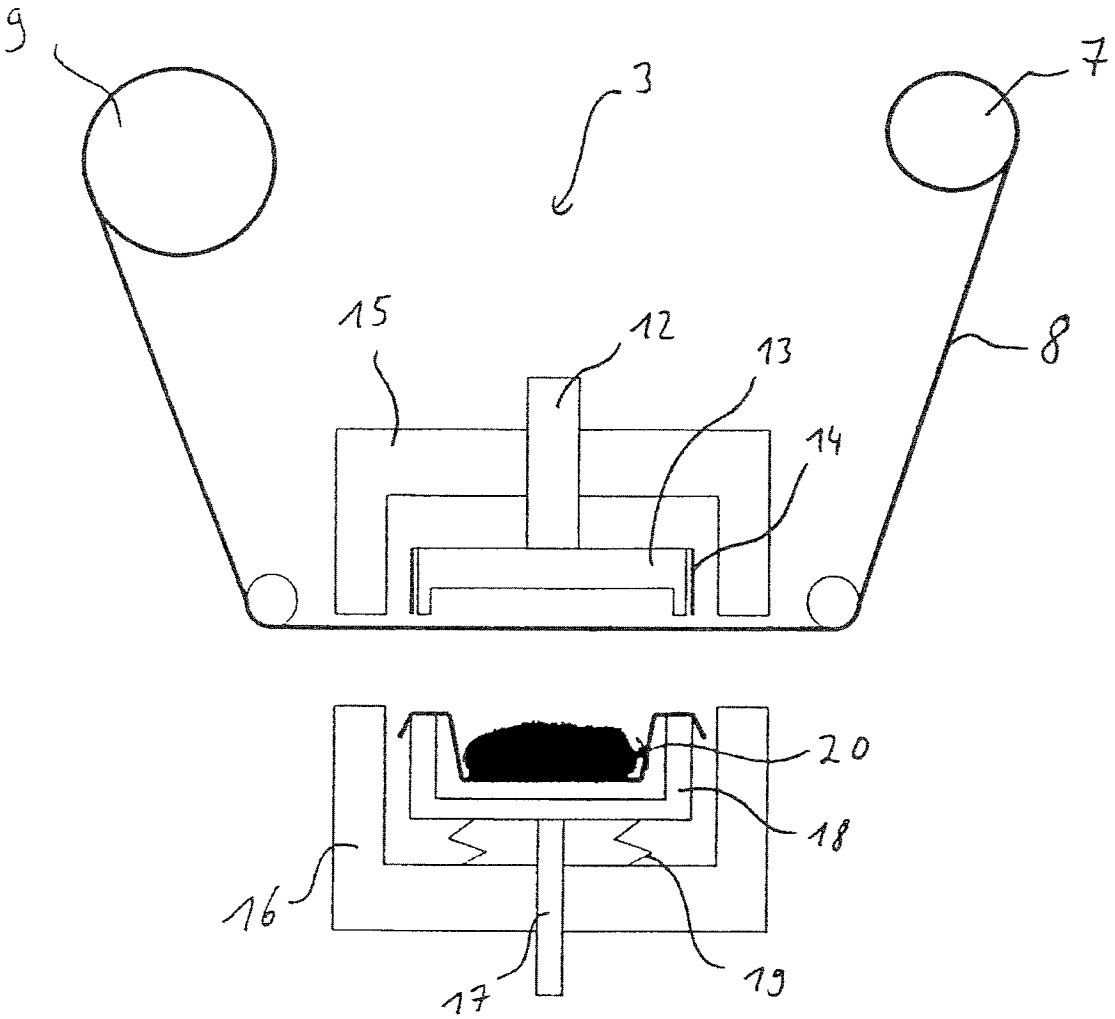
FIGS. 2 to 7 are schematic vertical cuts through a first embodiment of a sealing station according to the disclosure during different steps of a method according to the disclosure.

FIG. 2 shows a vertical sectional view of a sealing machine 3 according to the disclosure with the film feeding roll 7 and the remaining film winder 9 for the cover film 8. A lifting device 12 for a sealing frame 13, on which a blade 14 is arranged, is held in a tool upper part 15. The tool lower part 16 has a guide 17 for a tray holder 18 with at least one (compression) spring 19. A tray 20 that has been filled with a product and that has an edge the whole way around that is additionally angled downwards has been inserted into the tray holder 18 by a handling device that is not shown, or it has been inserted manually. For the sake of a simpler depiction, only one tray 20 is shown. In practice, a number of trays arranged one behind the other or one next to the other are closed with the cover film simultaneously in a sealing station.

Figure 3:
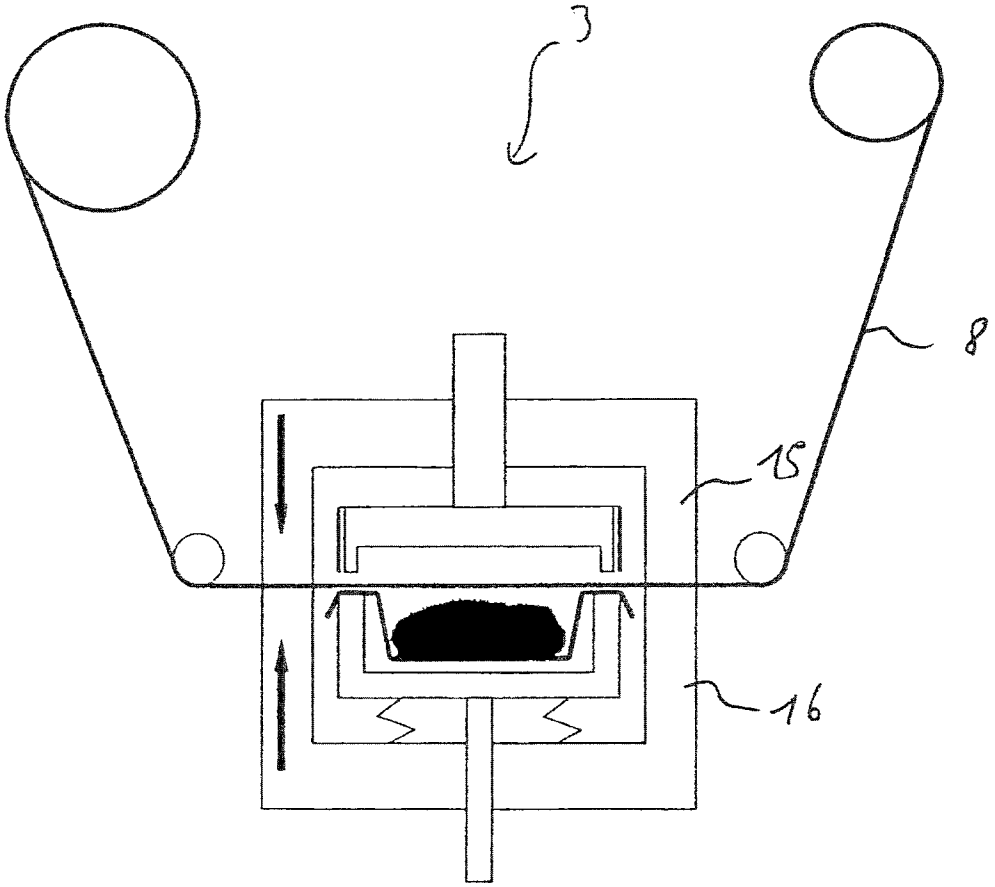

According to a method according to the present disclosure, as shown in FIG. 3, the cover film 8 is clamped around the edge by the tool upper part 15 and the tool lower part 16. This area, in which the cover film 8 is clamped, is defined as a first area. In this position, the tool upper part 15 and the tool lower part 16 form a closed chamber that is evacuated and/or treated with gas.

Figure 4:
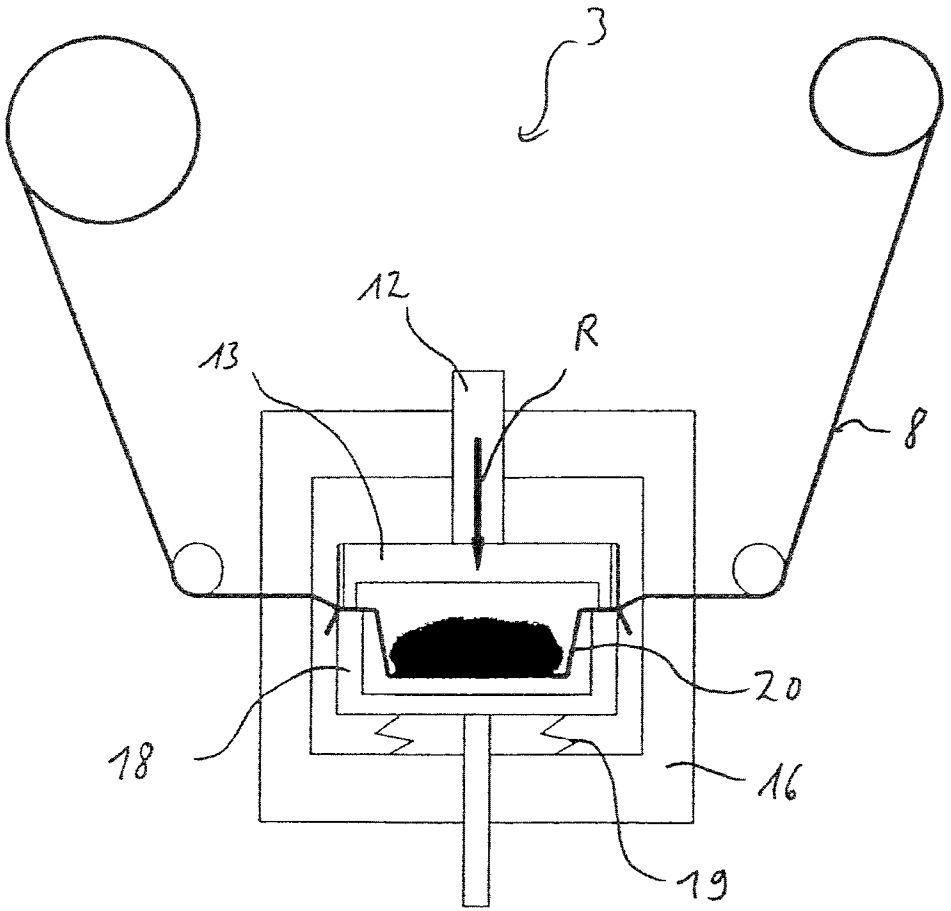

After the atmosphere exchange has been completed, the sealing frame 13 moves, as is shown in FIG. 4, downwards in the direction R by means of the lifting device 12 and clamps the cover film 8 in a second area to the tray 20 that is supported by the tray holder 18. The clamping force approximately corresponds to the spring force from the springs 19.

Figure 5:
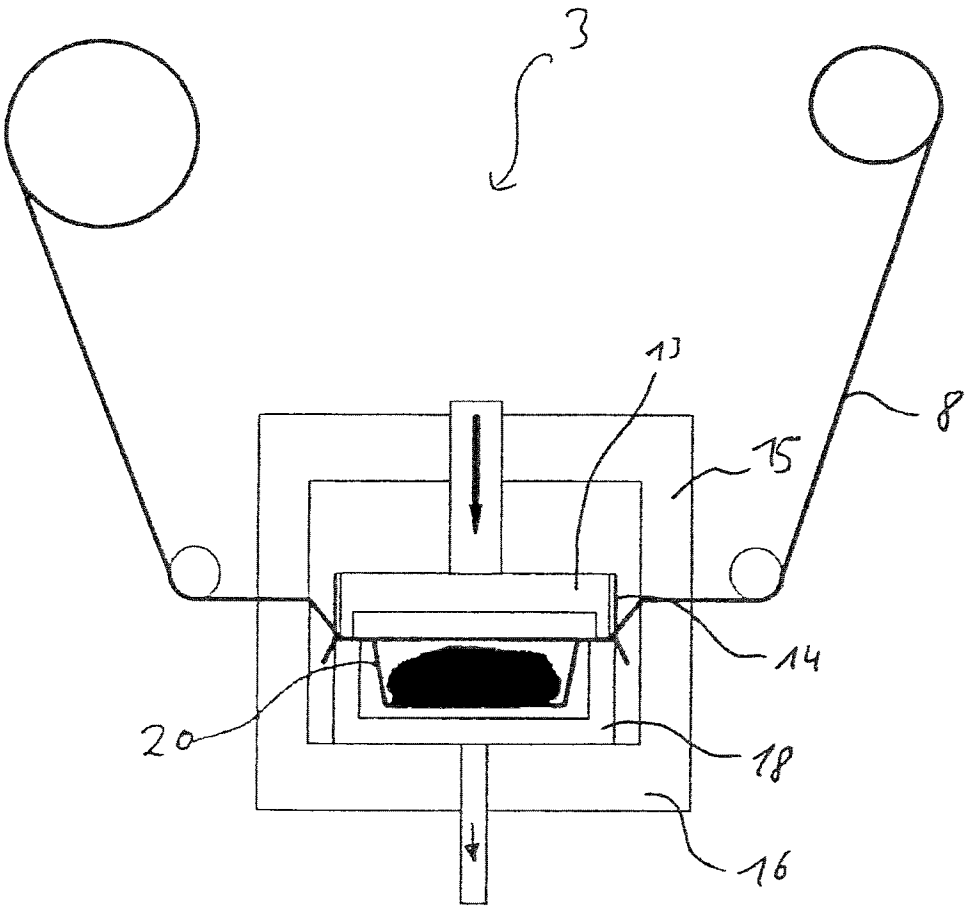

As shown in FIG. 5, the sealing frame 13 continues moving in the direction of the tool lower part 16. The tray holder 18 also moves downwards relative to the tool lower part 16. The springs 19 are thereby compressed together until such a point as the tray holder 18 strikes the tool lower part 16. As a result of this movement, the tray 20 with the second area of the cover film 8 is moved downwards relative to the tool lower part 16 and also to the tool upper part 15. This leads to tautening in the area of the cover film 8 that is not clamped in a second area by the sealing frame 13 and the tray holder 18 or in a first area by the tool upper part 15 and the tool lower part 16, respectively.

Due to the resulting diagonal position of the cover film 8 between the first and second area, in which the cover film 8 is clamped, the cover film 8 comes into contact with the blade 14 and is cut. The blade 14 preferably has a serrated form, which simplifies the cutting process. The cover film 8 is, for example, a plastic film or a multi-layer film that can also be heat-shrinkable or skinnable.

Figure 6:
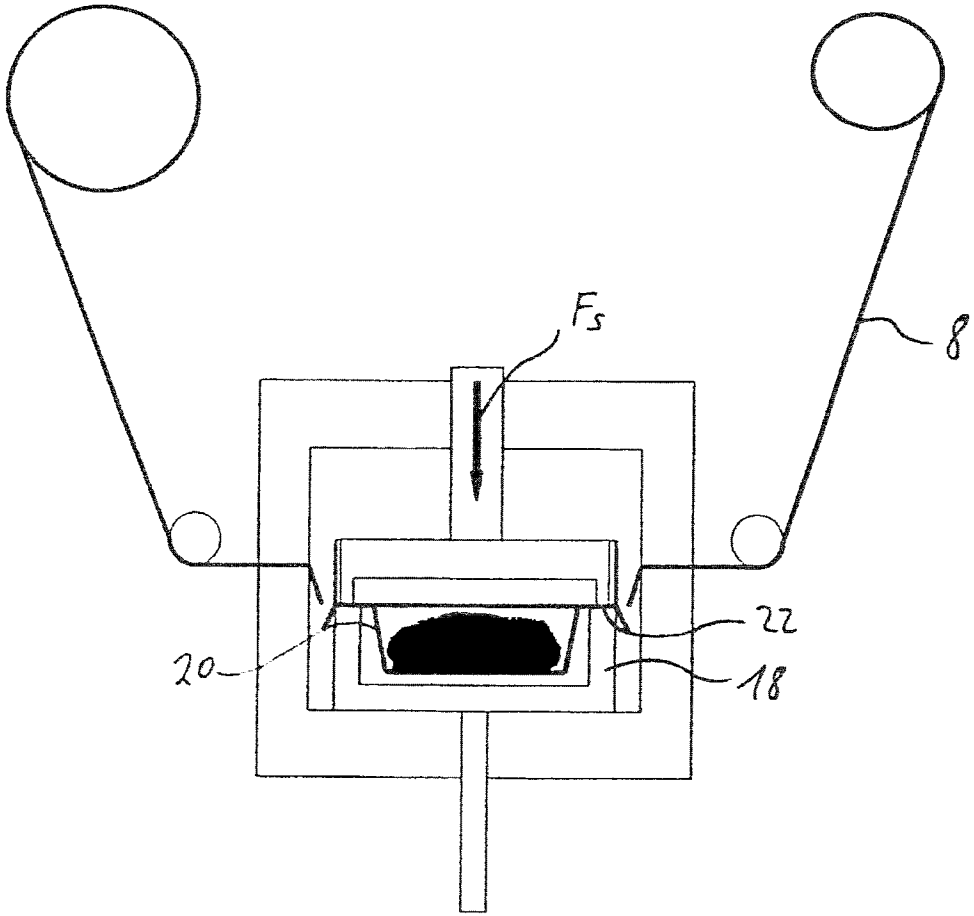

FIG. 6 shows that the sealing frame 13 is pressed further onto the tray holder 18 in order to produce the sealing force Fs that is needed in order to provide an airtight seal between the cover film 8 and the tray 20 in the area of the sealing seam 22.

Figure 7:
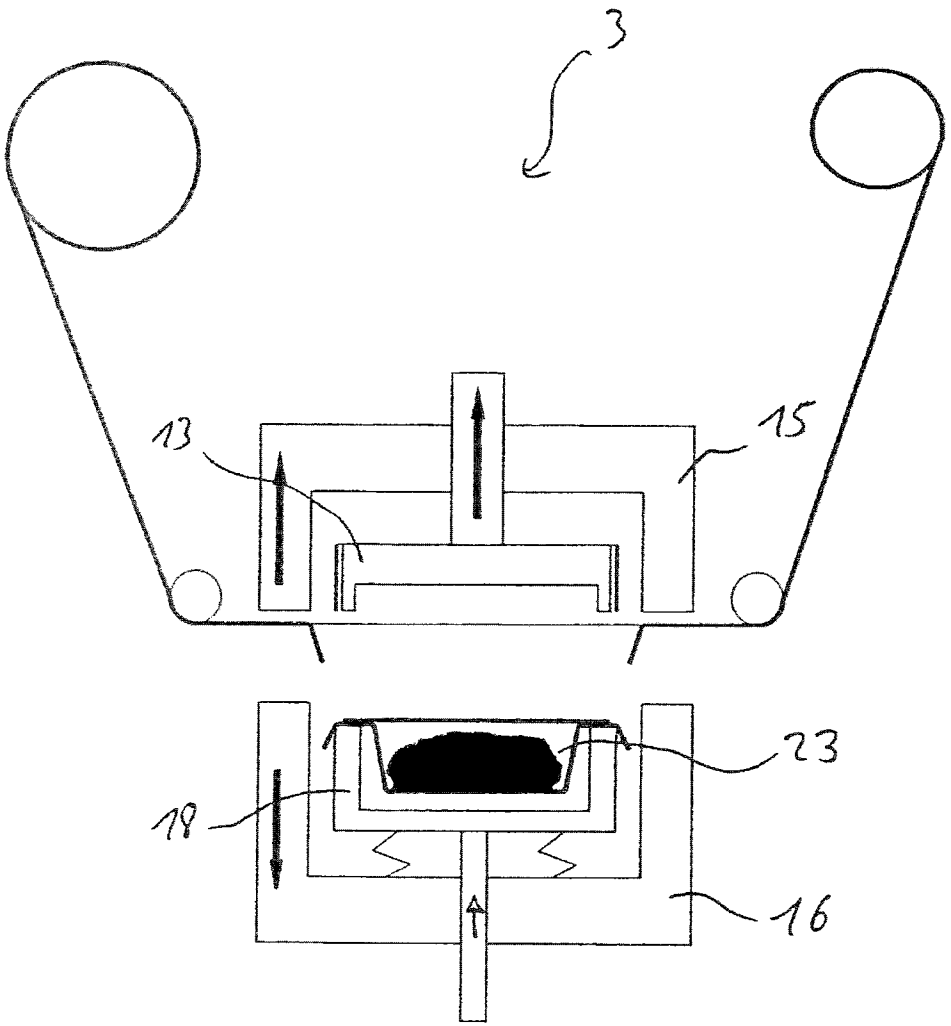

In FIG. 7, both the tool upper part 15 and the tool lower part 16 and also the sealing frame 13 and the tray holder 18 are moved so far apart from each other that the closed package 23 can be transported out of the sealing station 3 with a handling device, which is not shown.

Figure 8:
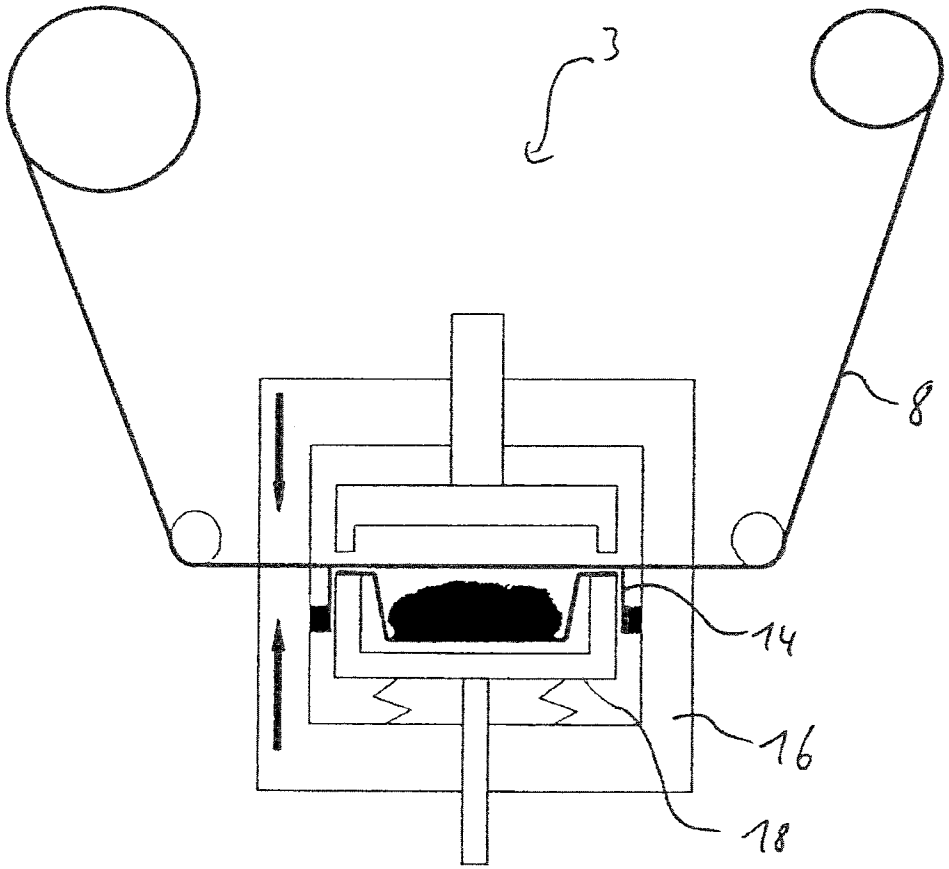
FIGS. 8 and 9 are schematic vertical cuts through a second embodiment of a sealing station according to the disclosure.

A variant of the arrangement of the blade 14 is shown in FIG. 8. The blade 14 is thereby arranged on the tool lower part 16, whereby the front edge of the blade is located very close to the tray holder 18 in order to cut the cover film 8 directly at the outer package edge.

Figure 9:
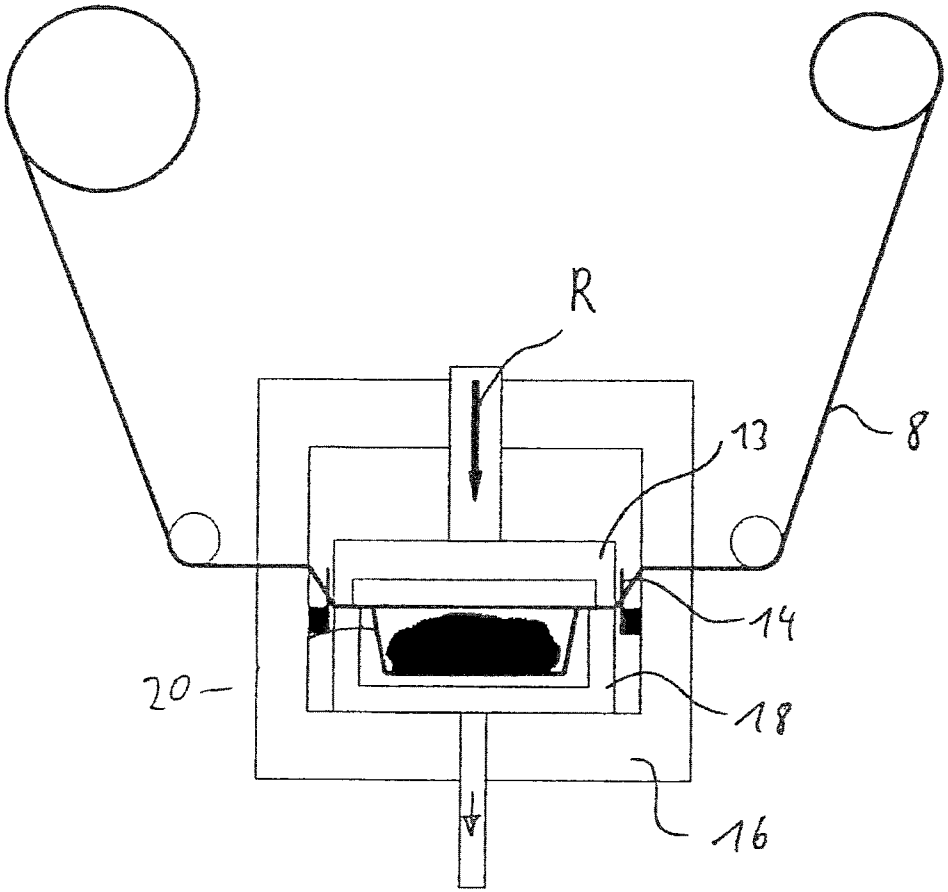

FIG. 9 shows how the relative movement R of the sealing frame 13 with the tray holder 18, together with the second area of the cover film 8 and the tray 20, downwards with respect to the tool lower part 16 causes the cover film 8 to be cut by the blade 14.

While embodiments of the disclosure have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for cutting a cover film in a sealing station of a tray sealing machine, the method comprising:

clamping the cover film in a first area between a tool upper part and a tool lower part of the sealing station;

clamping the cover film and a tray in a second area between a sealing frame and a tray holder;

moving the clamped second area of the cover film, the sealing frame and the tray holder as a group relative to the tool lower part; and cutting the cover film between a first perimeter of the first area and a second perimeter of the second area while moving the clamped second area of the cover film, the sealing frame and the tray holder as a group relative to the lower tool part by engaging the cover film with at least one blade, the at least one blade being fixedly connected to one of the sealing frame and the tool lower part.

2. The method according to claim 1 wherein the movement of the second area of the cover film, the sealing frame, and the tray holder as a group is toward the tool lower part.

3. The method according to claim 1 further comprising tautening an area of the cover film disposed between the first perimeter of the first area and the second perimeter of the second area of the cover film diagonally while moving the clamped second area of the cover film, the sealing frame and the tray holder as a group.

4. The method according to claim 1 wherein the at least one blade cuts the cover film between a sealing seam and an outer edge of the tray.

5. The method according to claim 1 wherein the cutting of the cover film is executed before the cover film is sealed to the tray.

6. The method according to claim 1 further comprising applying a sealing force on on the tray holder with the sealing frame via the cover film and the tray.

7. The method according to claim 1 further comprising evacuating and/or treating with gas an interior of the tray, and subsequently sealing the cover film to the tray.

8. A sealing station for a tray sealing machine, the sealing station comprising:

a tray holder for receiving a tray;

a tool upper part and a tool lower part for clamping a first area of a cover film therebetween;

a sealing frame for clamping a second area of the cover film to the tray between the sealing frame and the tray holder;

a blade for cutting the cover film, the blade being fixedly connected to one of the sealing frame and the tool lower part; and a lifting device operably engaged with the sealing frame, wherein the sealing frame and the tray holder are movable as a group relative to the tool lower part by the lifting device.

9. The sealing station according to claim 8 wherein a cutting portion of the blade and the sealing frame are spaced laterally apart by a distance of less than 6 mm.

10. The sealing station according to claim 8 wherein a cutting portion of the blade and the sealing frame are spaced laterally apart by a distance of less than 3 mm.

11. The sealing station according to claim 8 wherein the sealing frame forms a sealing seam between the cover film and the tray, and wherein the blade has a shape corresponding to an exterior contour of the sealing seam.

12. The sealing station according to claim 8 wherein, when the tray holder is in contact with the tool lower part, the lifting device is configured to produce a sealing force on the cover film and the tray via the sealing frame.

13. A packaging machine comprising a sealing station according to claim 8.

14. A sealing station for a tray sealing machine for sealing a cover film to a tray, the sealing station comprising:

a tool upper part and a tool lower part for clamping a first area of the cover film;

a tray holder disposed between the tool upper part and the tool lower part for receiving the tray;

a sealing frame that is cooperable with the tray holder to clamp a second area of the cover film to the tray;

a blade for cutting the cover film, the blade being disposed on the sealing frame or on the tool lower part; and a lifting device for moving the second area of the cover film, the sealing frame and the tray holder as a group relative to the tool lower part.

15. The sealing device of claim 14 wherein the lifting device is operably engaged with the sealing frame and is operable to move the second area of the cover film, the sealing frame and the tray holder as a group toward the tool lower part.

16. The sealing station of claim 14 wherein the lifting device is displaceable to move the sealing frame relative to the tray holder to clamp the second area of the cover film and the tray between the sealing frame and the tray holder, and wherein the lifting device is further displaceable to move the sealing frame, the tray holder and the second area of the cover film as a group relative to the lower tool part and a first perimeter of the first area of the cover film, thereby contacting the cover film with the blade to cut the cover film.

17. The sealing station of claim 14 wherein the lifting device is displaceable to move the sealing frame toward the tray holder to clamp the second area of the cover film and the tray between the sealing frame and the tray holder, and wherein the lifting device is further displaceable to move the sealing frame, the tray holder and the second area of the cover film as a group toward the lower tool part and away from a first perimeter of the first area of the cover film so that the blade engages and cuts the cover film.

* * * * *